US006412375B1

(12) United States Patent
Wang et al.

(10) Patent No.: US 6,412,375 B1
(45) Date of Patent: Jul. 2, 2002

(54) PLASTIC RIVET PULLER

(76) Inventors: Yu-Yen Wu Wang, No. 20, Lane 11, Ta Hsin 11 Street, Tai Pin City, Taichung Hsien; Jui-Fang Liao, 15F., No. 188, Chung Te 7 Street, Taichung, both of (TW)

( * ) Notice: Subject to any disclaimer, the term of this patent is extended or adjusted under 35 U.S.C. 154(b) by 0 days.

(21) Appl. No.: 09/850,182

(22) Filed: May 8, 2001

(51) Int. Cl.[7] ..... B25B 7/04; B25B 7/12

(52) U.S. Cl. ..... 81/418; 29/268; 254/18; 81/351

(58) Field of Search ..... 81/330–331, 334–335, 81/343–344, 348, 350–351, 325–327, 341, 385–386, 388–390, 394–395, 418–424, 424.5; 29/268; 254/23, 18, 28

(56) References Cited

U.S. PATENT DOCUMENTS 791,245 A * 5/1905 Casterlin ..... 81/351 X
1,586,297 A * 5/1926 Du Bois ..... 81/350 X
2,003,197 A * 5/1935 Jackson ..... 81/351 X
3,159,913 A * 12/1964 Winton ..... 81/351 X

* cited by examiner

*Primary Examiner*—D. S. Meislin

(57) ABSTRACT

A plastic rivet puller includes two handles pivoted together, a first jaw plate fixedly fastened to one handle, a second jaw plate adjustably fastened to the other handle in one of a series of angular positions and adapted to work with the first jaw plate to pull the stud element of a plastic rivet from the socket element of the plastic rivet, the first jaw plate having a rightwards extended front jaw tip terminating in a beveled front end edge, the second jaw plate having a leftwards extended front jaw tip terminating in a beveled front end edge and adapted to work with the front jaw tip of the first jaw plate and to force the stud element of the plastic rivet out of the socket element of the plastic rivet when turning the handles to close the first jaw plate and the second jaw plate, and a stop plate pivoted to the second jaw plate and adapted to stop the front jaw tip of the second jaw plate from touching the front jaw tip of the second jaw plate, preventing damage to the plastic rivet during the pulling operation.

3 Claims, 9 Drawing Sheets

PLASTIC RIVET PULLER

BACKGROUND AND SUMMARY OF THE INVENTION

The present invention relates to a rivet pulling tool and, more specifically, to a simple, compact plastic rivet puller, which can be conveniently adjusted to fit different working angles and, does not damage the rivet when pulling it.

A regular plastic rivet, as shown in FIGS. 1 and 2, is comprised of a socket element having a crossed center through hole, and a stud element adapted to engage the socket element. This structure of plastic rivet has been intensively used to join parts of furniture or automobile decorative devices. When separating the joined parts, the stud element must be removed from the socket element. When removing the stud element of a plastic rivet from its socket element, a nail puller or lineman's pliers may be used. However, when using a nail puller or lineman's pliers to remove the stud element from the socket element, the plastic rivet tends to be damaged or cut off.

The present invention has been accomplished to provide a plastic rivet puller, which eliminates the aforesaid drawbacks. It is one object of the present invention to provide a plastic rivet puller, which has a simple and compact structure. It is another object of the present invention to provide a plastic rivet puller, which can be conveniently adjusted to fit different working angles. It is still another object of the present invention to provide a plastic rivet puller, which does not damage the plastic rivet when pulling it.

According to one aspect of the present invention, the plastic rivet puller comprises two handles pivoted together, a first jaw plate fixedly fastened to one handle, and a second jaw plate adjustably fastened to the other handle in one of a series of angular positions and adapted to work with the first jaw plate to pull the stud element of a plastic rivet from the socket element of the plastic rivet. The first jaw plate has a rightwards-extended front jaw tip terminating in a beveled front end edge. The second jaw plate has a leftwards extended front jaw tip terminating in a beveled front end edge and adapted to work with the front jaw tip of the first jaw plate and to force the stud element of the plastic rivet out of the socket element of the plastic rivet when turning the handles to close the first jaw plate and the second jaw plate. According to another aspect of the present invention, a stop plate is pivoted to the second jaw plate, and turned relative to the second jaw plate between the nonworking position where the front jaw tip of the first jaw plate is allowed to touch the front jaw tip of the second jaw plate when turning the handles to close the first jaw plate and the second jaw plate, and the working position where the stop plate is stopped against the first jaw plate to prohibit the front jaw tip of the second jaw plate from touching the front jaw tip of the first jaw plate when turning the handles to close the first jaw plate and the second jaw plate.

DETAILED DESCRIPTION OF THE PREFERRED EMBODIMENT

Figure 1:
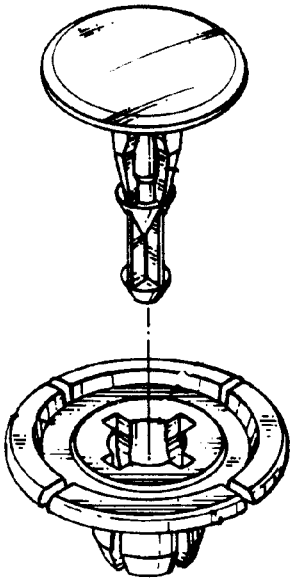
Fig. 1 PRIOR ART
FIG. 1 is an exploded view of a regular plastic rivet.
Figure 2:
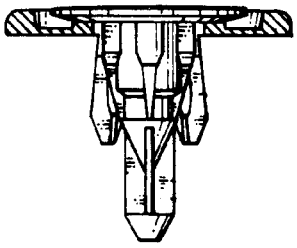
Fig. 2 PRIOR ART
FIG. 2 is a sectional assembly view of the plastic rivet shown in FIG. 1.
Figure 3:
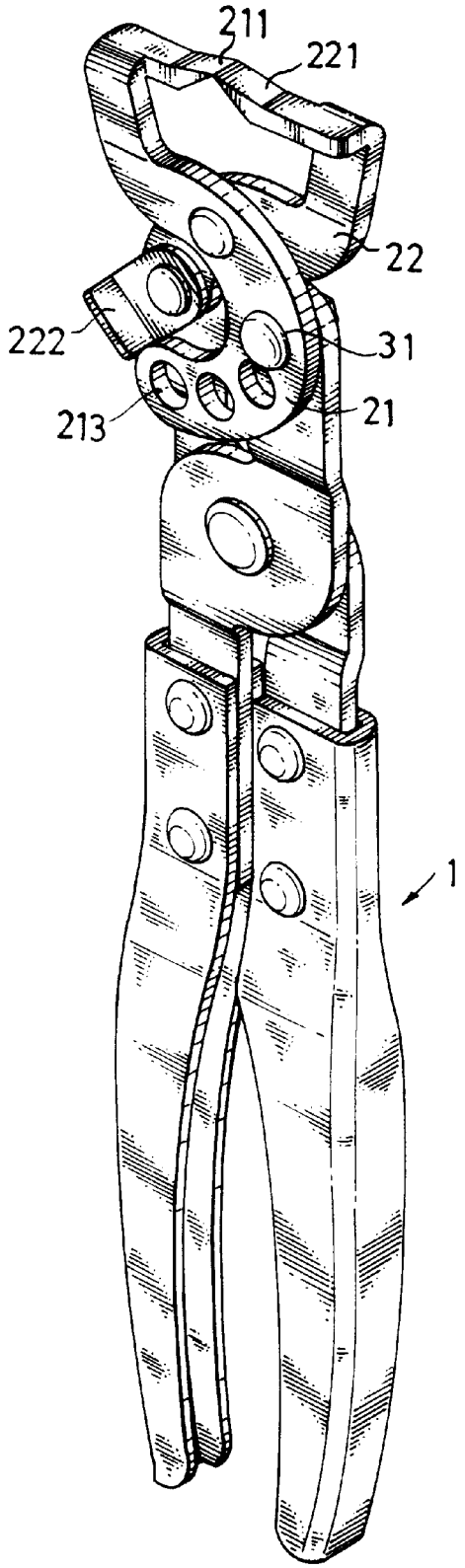
FIG. 3 is a perspective view of a plastic rivet puller according to the present invention.
Figure 4:
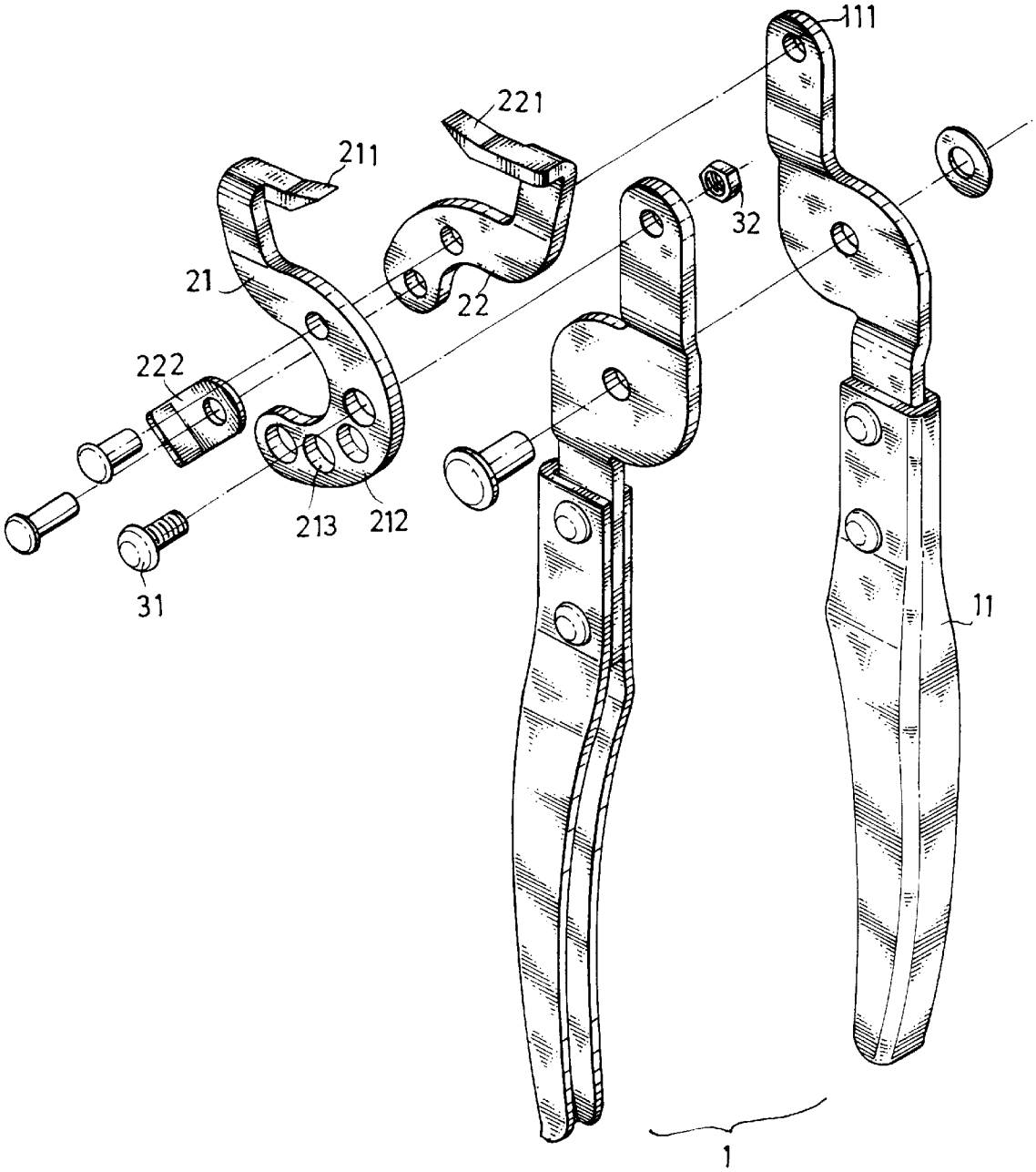
FIG. 4 is an exploded view of the plastic rivet puller according to the present invention.
Figure 5:
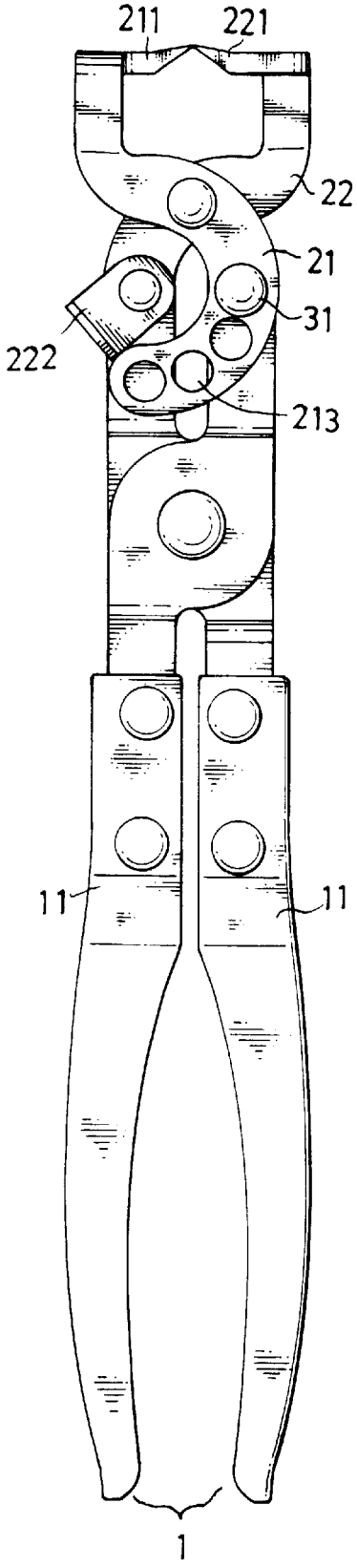
FIG. 5 is a plain view of the plastic rivet puller, showing the jaw plates closed.

Referring to FIGS. from 3 through 6, a plastic rivet puller in accordance with the present invention is generally comprised of a pliers body 1, and two jaw plates, namely, the first jaw plate 21 and the second jaw plate 22.

The pliers body 1 is comprised of two zigzag handles 11 pivoted together, each having a mounting hole 111 disposed at the respective front end adapted to receive the jaw plates 21 and 22 for enabling the jaw plates to be moved with the handles 11 in reversed directions relative to each other.

The first jaw plate 21 is shaped like "5", comprising a horizontal front jaw tip 211 extending rightwards and having a beveled front end edge, a smoothly arched outwardly extended rear coupling portion 212, and a series of adjustment holes 213 disposed in the rear coupling portion 212 and selectively fastened to the mounting hole 111 of one of the handles 11 of the pliers body 1 by a screw 31 and a nut 32.

The second jaw plate 22 is shaped like "5", comprising a leftwards extended horizontal front jaw tip 221 having a beveled front end edge, and an angled stop plate 222 fastened thereto near the rear end thereof The second jaw plate 22 has a middle part pivoted to the first jaw plate 21. The rear end (the end remote from the front jaw tip 221) is fixedly fastened to the mounting hole 111 of the other of the handles 11 of the pliers body 1. The angled stop plate 222 can be turned relative to the second jaw plate 22 between the working position and the non-working position. When turning the handles 11 to close the jaw plates 21 and 22 after the stop plate 222 has been turned to the working position, the stop plate 222 is stopped against the rear end of the first jaw plate 21, preventing the jaw tips 211 and 221 from cutting off the plastic rivet. Further, the beveled front end edge of the front jaw tip 211 of the first jaw plate 21 and the beveled front end edge of the front jaw tip 221 of the second jaw plate 22 respectively slop downwards inwards at a bottom side in the reversed directions.

When moving the handles 11 of the pliers body 1 to close the jaw plates 21 and 22, the front jaw tips 211 and 221 define with the jaw plates 21 and 22 a retaining hole having a substantially Λ-shaped top side and a substantially V-shaped bottom side for clamping the plastic rivet positively. When turning handles 11 to close the jaw plates 21 and 22, the beveled front end edge of the front jaw tip 211 of the first jaw plate 21 and the beveled front end edge of the front jaw tip 221 of the second jaw plate 22 are moved toward each other and acted on the stud element of the plastic rivet, causing the stud element of the plastic rivet to be moved upwards and forced out of the socket element of the plastic rivet.

Figure 6:
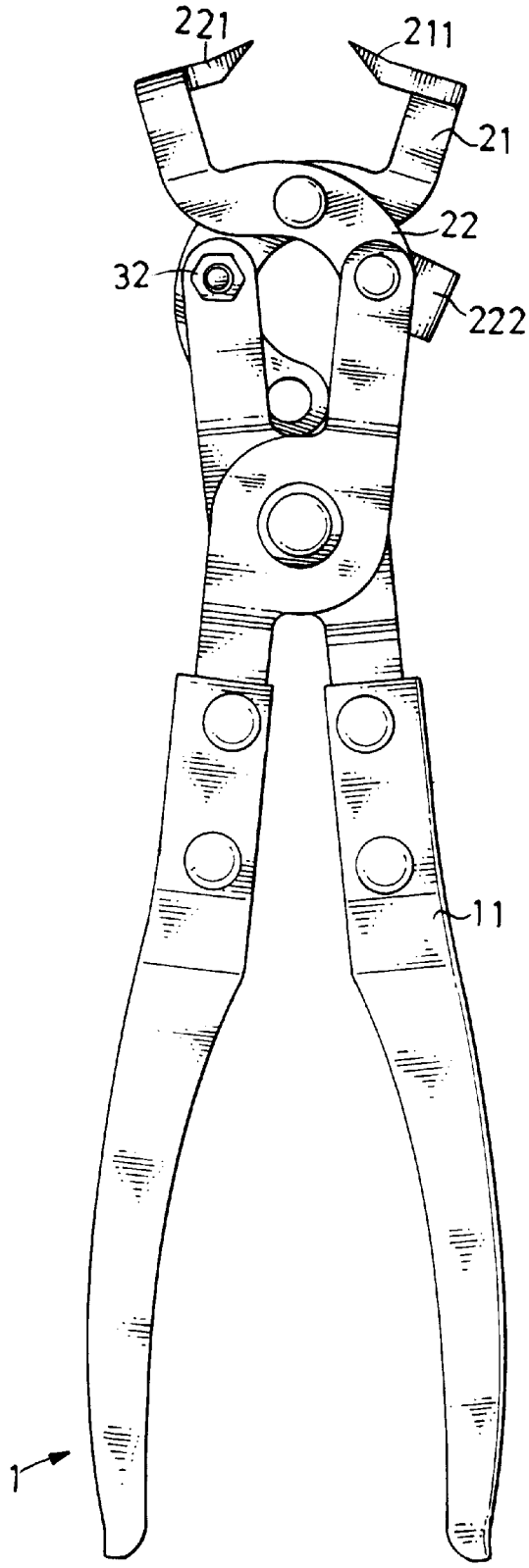
FIG. 6 is another plain view of the plastic rivet puller, showing the jaw plates opened.
Figure 7:
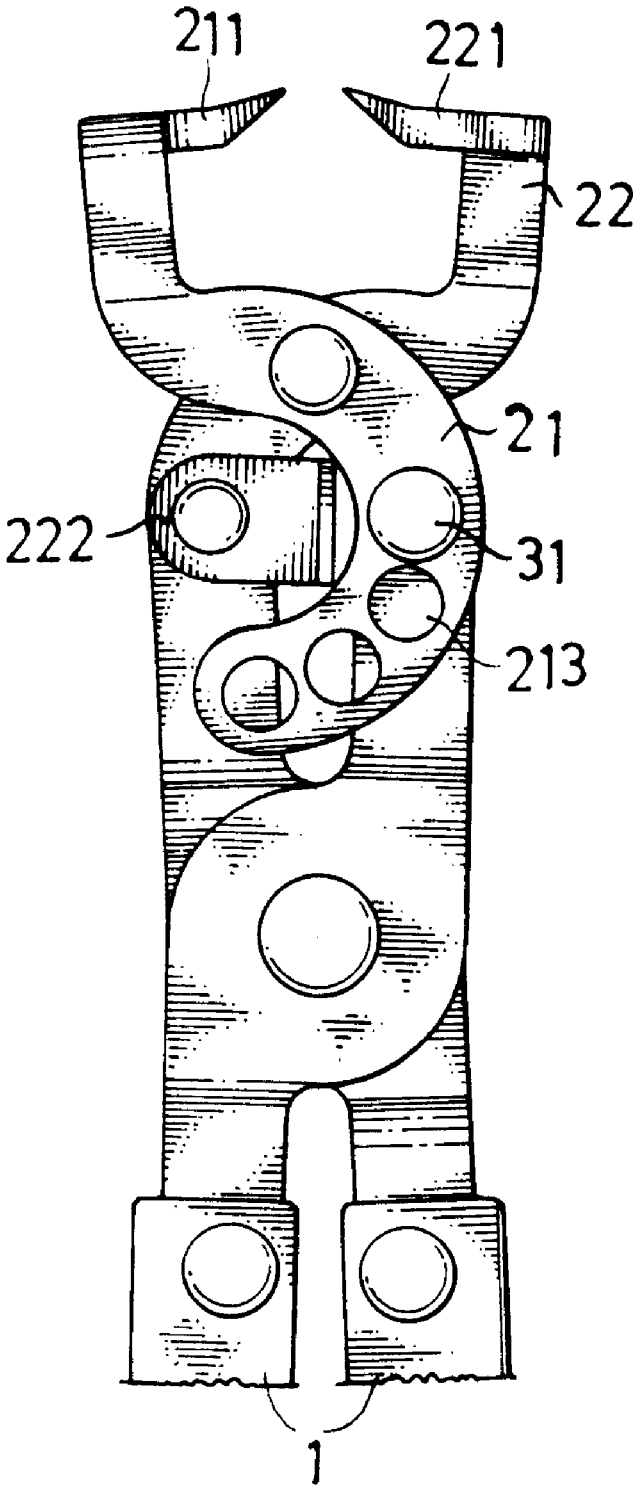
FIG. 7 illustrates the stop plate turned to the working position and stopped against the first jaw plate according to the present invention.
Figure 8:
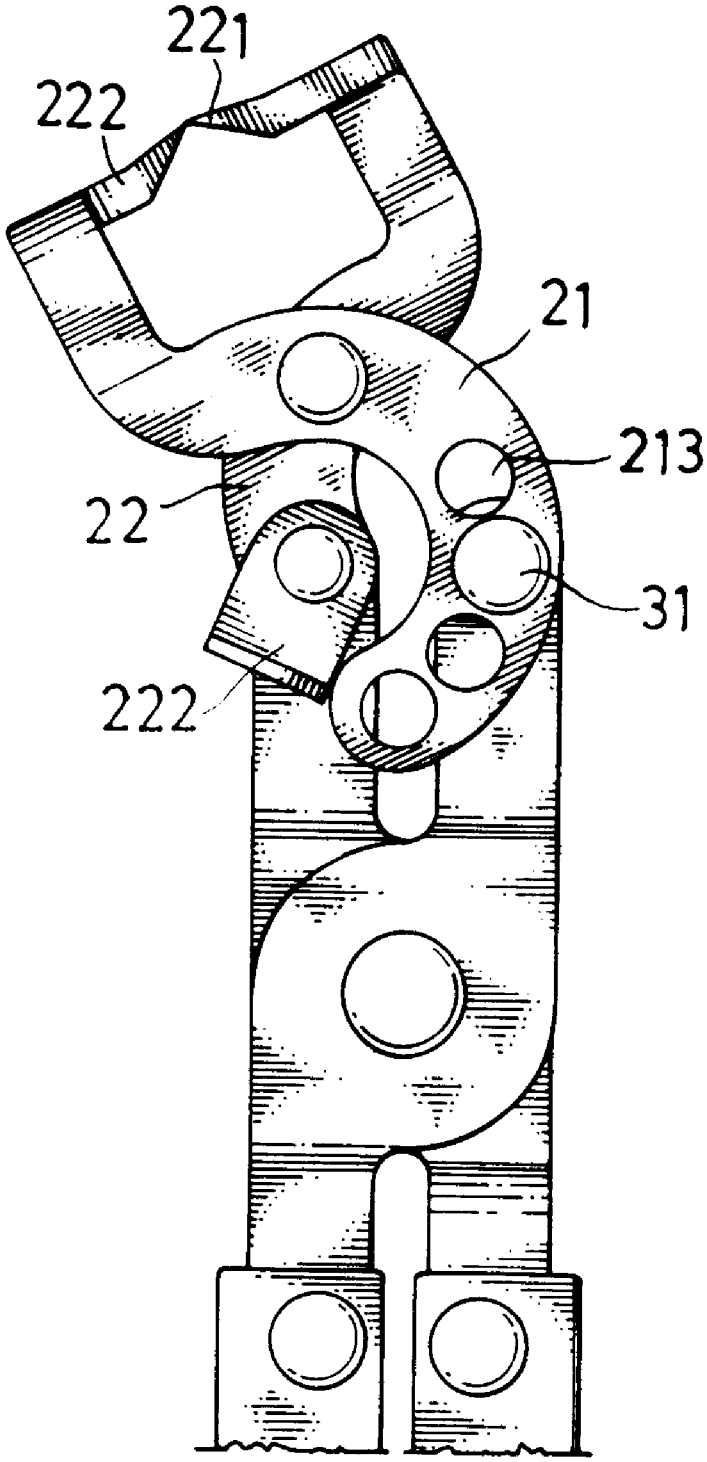
FIG. 8 shows a small angle adjustment example of the plastic rivet puller according to the present invention.
Figure 9:
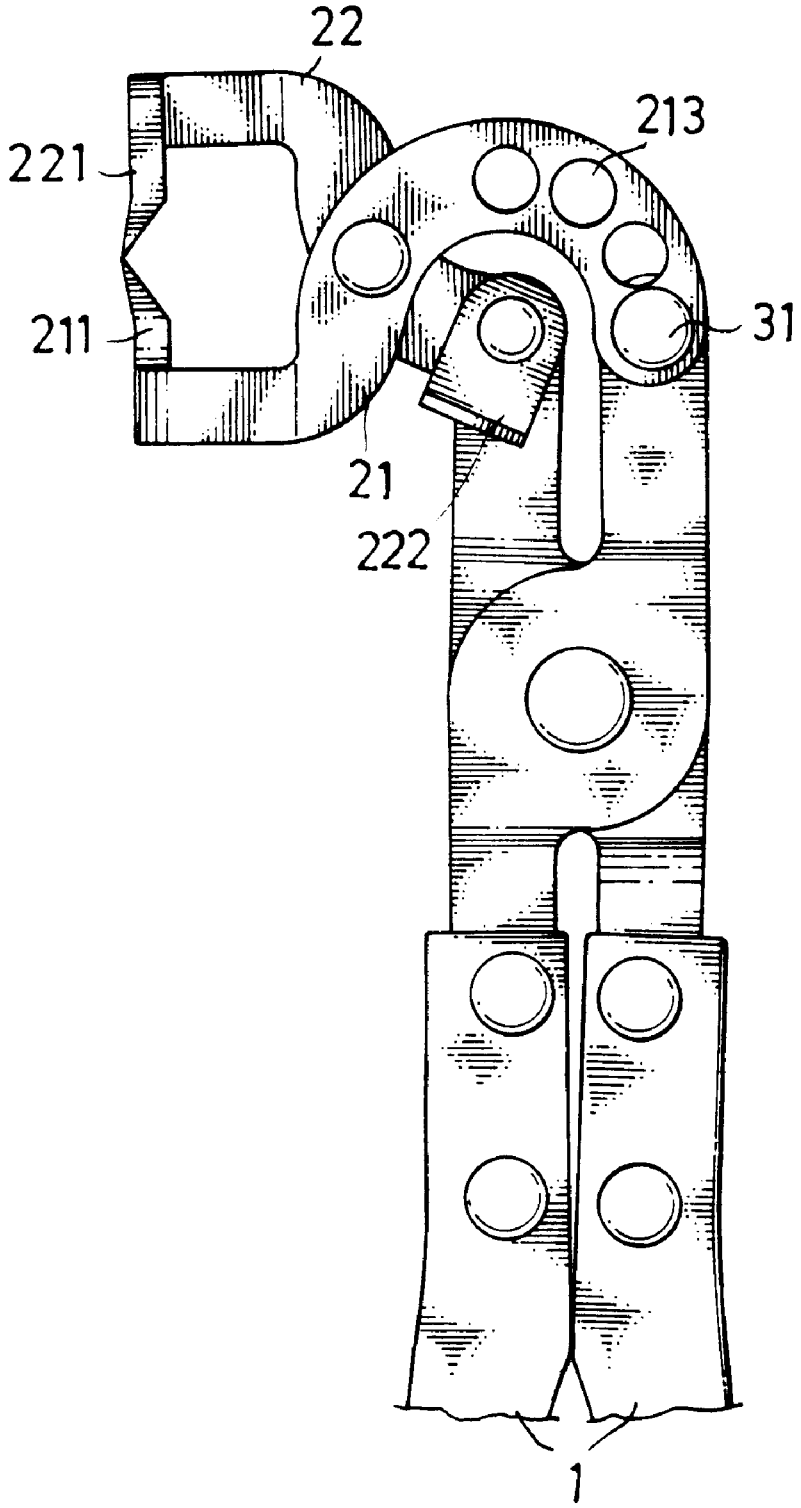
FIG. 9 shows a bit angle adjustment example of the plastic rivet puller according to the present invention.
Figure 10:
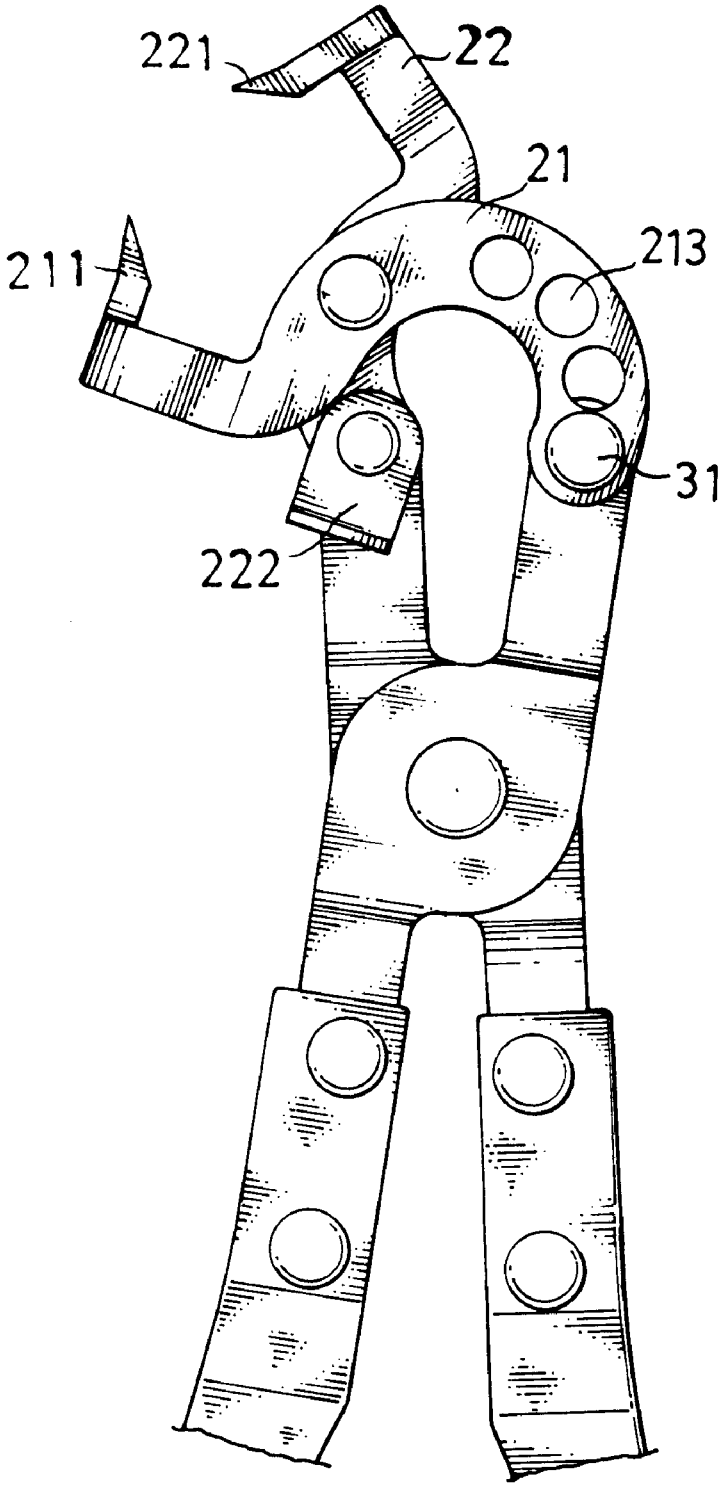
FIG. 10 is similar to FIG. 9 but showing the jaw plates opened.

Referring to FIG. 7 and FIG. 6 again, when turning the handles 11 to close the jaw plates 21 and 22 after the stop plate 222 has been turned to the non-working position, the front jaw tip 211 of the first jaw plate 21 and the front jaw tip 221 of the second jaw plate 22 are moved into contact with each other (see FIG. 6). When turning the handles 11 to close the jaw plates 21 and 22 after the stop plate 222 has been turned from the non-working position shown in FIG. 6 to the working position shown in FIG. 7, the front jaw tip 211 of the first jaw plate 21 is stopped from touching the front jaw tip 221 of the second jaw plate 22, preventing the jaw plates 21 and 22 from damaging the plastic rivet.

Referring to FIGS. from 8 through 10, after removal of the nut 32 from the screw 31, the screw 31 can be shifted from one adjustment hole 213 to another to change the angular position of the first jaw plate 21 relative to the corresponding handle.

A prototype of plastic rivet puller has been constructed with the features of FIGS. 3~10. The plastic rivet puller functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A plastic rivet puller of the type comprising a pliers body formed of two handles pivoted together, a first jaw plate fastened to one of the handles of said pliers body, and a second jaw plate fastened to the other of the handles of said pliers body and adapted to work with said first jaw plate to pull the stud element of a plastic rivet from the socket element of the plastic rivet, wherein said first jaw plate has a rightwards extended front jaw tip, a smoothly arched and leftwards extended coupling portion, and a plurality of adjustment holes arranged along said smoothly arched and leftwards extended coupling portion and selectively fastened to one of the handles of said pliers body by a screw and a nut; said second jaw plate has a leftwards extended front jaw tip, which is aimed at the rightwards extended front jaw tip of said first jaw plate when turning the handles of said pliers body to close said first jaw plate and said second jaw plate, and adapted to work with the front jaw tip of said first jaw plate and to force the stud element of the plastic rivet out of the socket element of the plastic rivet.

2. The plastic rivet puller of claim 1 wherein the front jaw tip of said first jaw plate and the front jaw tip of said second jaw plate each have a beveled front end edge respectively sloping downwards inwards at a bottom side.

3. The plastic rivet puller of claim 1 further comprising a stop plate pivoted to said second jaw plate and turned relative to said second jaw plate between a first position where the front jaw tip of said first jaw plate is allowed to touch the front jaw tip of said second jaw plate when turning the handles of said pliers body to close said first jaw plate and said second jaw plate, and a second position where said stop plate is stopped against said first jaw plate to prohibit the front jaw tip of said second jaw plate from touching the front jaw tip of said first jaw plate when turning the handles of said pliers body to close said first jaw plate and said second jaw plate.

* * * * *